US005753598A

United States Patent [19]

Briffett

[11] Patent Number: 5,753,598

[45] Date of Patent: May 19, 1998

[54] LUBRICATING OIL COMPOSITIONS OR CONCENTRATES THEREFOR PROVIDING ENHANCED WATER-SHEDDING PROPERTIES

[75] Inventor: Neil Edward Briffett, Wantage, Great Britain

[73] Assignee: Exxon Research and Engineering Company, Florham Park, N.J.

[21] Appl. No.: 750,629

[22] PCT Filed: Jun. 27, 1995

[86] PCT No.: PCT/GB95/01504

§ 371 Date: Mar. 11, 1997

§ 102(e) Date: Mar. 11, 1997

[87] PCT Pub. No.: WO96/00766

PCT Pub. Date: Jan. 11, 1996

[30] Foreign Application Priority Data

Jun. 28, 1994 [GB] United Kingdom ..... 9413005

[51] Int. Cl.[6] ..... C10M 141/08; B01D 17/05

[52] U.S. Cl. ..... 508/221; 508/231; 508/271; 508/272; 508/273; 508/579; 252/331; 252/344; 252/358

[58] Field of Search ..... 508/271, 272, 508/273, 579, 231, 221; 252/331, 344, 358

[56] References Cited

U.S. PATENT DOCUMENTS

| | | | |
|---|---|---|---|
| 2,250,408 | 7/1941 | De Groote | 252/344 |
| 3,509,052 | 4/1970 | Murphy | 508/579 |
| 4,402,845 | 9/1983 | Zoleski et al. | 508/579 |
| 4,849,118 | 7/1989 | Stauffer et al. | 508/273 |
| 5,084,197 | 1/1992 | Galic et al. | 508/579 |

FOREIGN PATENT DOCUMENTS

| | | |
|---|---|---|
| 311318 | 4/1989 | European Pat. Off. . |
| 330522 | 8/1989 | European Pat. Off. . |
| 391649 | 10/1990 | European Pat. Off. . |
| 9004626 | 5/1990 | WIPO . |
| 9213933 | 8/1992 | WIPO . |

*Primary Examiner*—Jerry D. Johnson

*Attorney, Agent, or Firm*—Susan Fletcher Watts; Joseph J. Allocca

[57] ABSTRACT

The combination (mixture and/or reaction product) of an epoxy based demulsifier and a heterocyclic compound, e.g. dimercaptoth-iadiazole, has been found to exhibit synergistic activity in marine oil formulations especially Trunk Piston Oils. The combination produces Trunk Piston Oils with improved water-shedding properties.

25 Claims, No Drawings

LUBRICATING OIL COMPOSITIONS OR CONCENTRATES THEREFOR PROVIDING ENHANCED WATER-SHEDDING PROPERTIES

The invention relates to demulsifier compositions and to improvements in oil compositions, particularly in lubricating oil compositions. The invention has particular relevance to lubricating oils for marine engines, but is not limited thereto.

Oils for use in marine engines generally fall into one of three main classes, namely marine diesel cylinder lubricants (MDCLs) and trunk piston engine oils (TPEOs), and system oils. Under the crankcase conditions in which TPEOs are normally used (the presence of condensation, the possibility of water contamination, and the use of a lubricant purification system), there is a tendency for water to form an emulsion with the oil, which will normally contain a dispersant and a metal-containing detergent. Emulsion formation may also be a problem with system oils, although, as system oils normally contain less metal-containing detergent than TPEOs, or no metal-containing detergent at all, the tendency of system oils to form emulsions is generally lower than for TPEOs.

The formation of emulsions is undesirable, as an emulsion may interfere with the working of the oil and/or of parts of the engine, and/or the intimate association of the oil and the water in the emulsion may result in an increased tendency for additives in the oil to become dissolved or dispersed in the water and to be lost from the oil when the oil is purified by the removal of water. Further, the presence of an emulsion may also result in blocking of filters and reduced efficiency of centrifuges used in purification of the oil.

There have been numerous proposals to incorporate demulsifiers in oil compositions. For example as disclosed in EP 333 141 A, U.S. Pat. No. 3,752,657, U.S. Pat. No. 4,440,902, U.S. Pat. No. 4,885,110, GB. 2 008 146 A, U.S. Pat. No. 4,705,834, DE 3 635 489 A, EP 333 135 A, GB 1 186 659. EP 330 522 A discloses an oil-soluble mixture useful as an oil additive which comprises a specified lubricating oil ashless additive, a demulsifier additive comprising the reaction product of an alkylene oxide and an adduct of a bis-epoxide and a polyhydric alcohol, and a compatibility additive for enhancing the solubility of the demulsifier in the oil solutions in which it is used. The compatibility additive comprises an alcohol, for example, a glycol, ester or hydroxyamide derivative of a carboxylic acid having a total of from 24 to 90 carbon atoms and at least one carboxylic group per molecule, preferred compatibility additives being dimer acid esters, the dimer acids being cyclohexene dicarboxylic acids formed from $C_{18}$ to $C_{22}$ unsaturated fatty acids.

EP 391 649 A describes an ashless lubricating composition for heavy duty diesel engines. The lubricant contains an oil-soluble sulphur compound as a corrosion inhibitor, for example a thiadiazole compound. It may also contain demulsifier.

Despite the above proposals there remains a need for additives having a highly effective demulsifying action and, in particular, having a highly effective demulsifying action in TPEOs and system oils. Some demulsifier systems have solubility problems associated with their use in oils. Demulsifier systems with improved solubility in oils and/or activity in oils are therefore desirable.

It has surprisingly been found that the effectiveness of demulsifier systems especially demulsifier systems derived from epoxy group containing materials such as crosslinked polyoxyalkylene polyol demulsifiers can be enhanced when they are used in combination with certain heterocyclic compounds. This combination provides what is believed to be a synergistic interaction. Whatever the exact mechanism this invention enables improved water shedding performance at a given level of demulsifier to be achieved. Some demulsifiers are associated with stability problems in certain lubricating oil formulations; this problem manifests itself in the occurrence of haze and/or sedimentation. The present invention may allow lower levels of demulsifier to be used in formulations without loss of water shedding performance with the possibility of a consequential cost saving due to the use of less additive and in some cases enhanced formulation stability.

The present invention provides a demulsifier composition comprising;

a) optionally an oleaginous medium, and b) a demulsifier system formed from mixing:

(i) at least one demulsifier derived from epoxy group-containing materials, optionally with one or more additional constituents selected from oxyalkylene groups and one or more free acids/anhydrides, or a mixture thereof, and (ii) at least one heterocyclic compound of the formula:

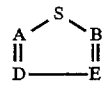

I wherein each of A, B, D and E is either nitrogen or a —CR group where R is hydrogen, a mercapto group, or a substituted or an unsubstituted hydrocarbyl group, provided at least one and no more than two of A, B, D and E is/are nitrogen, wherein the weight ratio of heterocyclic compound (ii) to demulsifier (i) is less than 1:1.

The demulsifier system may comprise a mixture of the demulsifier and heterocyclic compound and/or the reaction product thereof.

The present invention also provides the use of a heterocyclic compound of general formula I to enhance the activity of a demulsifier for a water-in-oil emulsion.

The invention also provides for the use of a heterocyclic compound of general formula I to improve the water shedding properties of a lubricating oil composition.

The invention further provides a lubricating oil composition comprising an oil of lubricating viscosity as a major component, and a demulsifier system as defined above present in the composition in an amount effective to enhance the demulsification properties of the demulsifier.

A lubricating oil composition in accordance with the invention may comprise one or more additional additives, particularly one or more ashless dispersant additives and/or one or more overbased metal-containing detergent additive compounds and/or one or more zinc dihydrocarbyl dithiophosphates (ZDDPs) and/or one or more antioxidants. A lubricating oil composition in accordance with the present invention may also comprise a free (as hereinafter defined) dicarboxylic acid or anhydride.

In a preferred aspect of the invention, the lubricating oil is suitable for marine use, particularly for use as a TPEO or a system oil, and is formulated using constituents, and proportions of constituents, appropriate to such use. A lubricating oil suitable for use as a TPEO will normally contain at least one ashless dispersant at least one overbased metal detergent and at least one ZDDP, and will typically have a Total Base Number (TBN) in the range of from 6 to 50 e.g. 9 to 40. The TBN of a system oil will normally be in the range of from 0 to 12 e.g. 0 to 6. All TBN's indicated in this specification are measured according to ASTM D2896.

The invention also provides a concentrate useful as an additive for a lubricating oil composition which concentrate comprises oil and/or a solvent miscible with oil as a minor component, and a demulsifier composition as defined above.

A concentrate in accordance with the present invention may comprise one or more additional additives, particularly one or more ashless dispersants and/or one or more overbased metal detergents, and/or one or more ZDDP additives. Where the concentrate is for preparing marine lubricating oil compositions such as a TPEO, it preferably has a TBN in the range of from 150 to 400.

The demulsifier composition may be made by, for example, blending a mixture and/or reaction product of at least one demulsifier with optional additional constituents and at least one heterocyclic compound of general formula I into an oleaginous medium. The oleaginous medium may be an oil or may be a solvent miscible with oil e.g. aromatic solvent. Alternatively, the demulsifier composition may be prepared by the blending and/or reaction with a heterocyclic compound of general formula I and the demulsifier during its manufacture. If the manufacture is a multistage manufacture this addition and/or reaction may be made during any stage of the manufacture but is preferably made before isolation of the demulsifier composition. Addition and/or reaction of the heterocyclic compound may be made at a temperature of e.g. up to 150° C. or higher. The heterocyclic compound and the demulsifier (with any optional additional constituents) may react fully or partially, and thereby form a demulsifier system or demulsifier composition. The demulsifier composition typically comprises at least 10 wt % (e.g. 20 to 100 wt %) based on an active ingredient basis of the demulsifier system. Preferably there is at least 30 wt % (e.g. 30 to 100 wt %) of demulsifier system present in the demulsifier composition and most preferably at least 50 wt % (e.g. 50 to 100 wt %). Ideally the demulsifier composition contains as much of the demulsifier system as possible. The exact levels of demulsifier system will depend inter alia on the ratio of its component parts such as the demulsifier and the heterocyclic compound and their relative compatibility with each other and/or solubility or dispersibility into the oleaginous medium when present (either separately and/or as a reaction product) in the composition. When present in the composition the oleaginous medium will typically constitute the balance of the demulsifier composition although relatively small amounts (e.g. less than 10 wt %) of other materials such as impurities may also be present.

The lubricating oil composition may be blended by conventional techniques, for example, by blending, in any order, an oil of lubricating viscosity, and a mixture and/or reaction product of a demulsifier (with optional additional constituents) and a heterocyclic compound of general formula I in an amount effective to enhance the demulsification properties of the demulsifier. It is preferred that blending and/or reacting is at a temperature of up to 100° C. preferably up to 60° C. In one preparatory method, the demulsifier is added in a second stage after blending of the other components into the lubricating oil. When the method is used to prepare a concentrate as defined above, the demulsifier is preferably added to the heterocyclic compound of general formula I or to a mixture of other additives such as a mixture of one or more ashless dispersant additives, one or more overbased metal detergent additives, and one or more ZDDP additives which have been pre-blended; the heterocyclic compound of general formula I may also be included in the pre-blend.

The use in accordance with the invention of the demulsifier composition makes it possible to obtain lubricating oil compositions, and especially TPEOs and system oils, which have improved emulsion performance as indicated by the ability of the formulation containing the combination to shed water, even when used in the presence of water or water vapour.

The demulsifiers which may be used in accordance with the invention include those described in, for example, EP 333 141 A, U.S. Pat. No. 3,752,657, U.S. Pat. No. 4,440,902, U.S. Pat. No. 4,885,110, GB.2 008 146 A, U.S. Pat. No. 4,705,834, DE 3 635 489 A, EP 333135 A, GB 1 186 659, and EP 330 522 A.

The demulsifiers are those which are derived from epoxy group containing materials such as for example ethylene oxide, propylene oxide and epoxy resins. Preferred demulsifiers for use in accordance with the present invention comprise at least one crosslinked polyoxyalkylene polyol, and may also comprise one or more other constituents which, together with the crosslinked polyoxyalkylene polyol, impart demulsifying properties to the mixture.

By a polyoxyalkylene polyol is meant any compound containing at least two oxyalkylene units and at least two hydroxyl groups. The term "crosslinked polyoxyalkylene polyol" includes not only compounds made by reacting one or more polyoxyalkylene polyols with a crosslinking agent but also, for example, compounds in which a difunctional compound, for example, one of those mentioned below as being suitable for use as a crosslinking agent, is treated with one or more alkylene oxides to give a product containing at least two oxyalkylene chains.

Preferred demulsifiers for use in accordance with the invention are produced by reacting with a crosslinking agent a polyoxyalkylene polyol produced by reacting a polyol with one or more alkylene oxides or oxyalkylene mono- and copolymers. Suitable polyols include, for example, alkylene glycols, alkylene triols and alkylene tetrols, for example, ethylene glycol, propylene glycol, dipropylene glycol, glycerol, and pentaerythritol. Aromatic hydroxyl compounds, for example, alkylated mono- and polyhydric phenols and naphthols can also be used.

The total number of carbon atoms in alkylene oxides from which oxyalkylene groups are derived advantageously does not exceed 10, and is preferably 2 to 4. Examples of such alkylene oxides are ethylene oxide, propylene oxide, 1,2-epoxy butane, 2,3-epoxy butane, 1,2-epoxy pentane, 2,3-epoxy pentane, 1,2-epoxy hexane, 2,3-epoxy hexane, 3,4-epoxy hexane, and 1,2-epoxy-3-methylbutane. Particularly preferred alkylene oxides are ethylene oxide and propylene oxide. The alkylene oxides may, if desired, contain non-hydrocarbon substituents provided that these do not interfere with the use of the alkylene oxides or demulsifiers derived therefrom.

When a polyoxyalkylene polyol contains units derived from more than one alkylene oxide, these units may be randomly distributed (if a mixture of two or more different alkylene oxides is used) or in blocks (if different alkylene oxides are added sequentially to the reaction vessel). Where block polymers are prepared, the nature of the alkylene oxides used in forming the blocks, and the number of repeating units, may be chosen by the person skilled in the art having regard to the properties desired for the block polymers. Thus, for example, oxypropylene blocks are normally relatively hydrophobic and oxyethylene blocks relatively hydrophilic.

Preferred polyoxyalkylene polyols from which crosslinked compounds for use in accordance with the invention may be derived are obtained by reacting dipropylene glycol or a triol with propylene oxide.

Crosslinking of polyoxyalkylene polyols may be effected using a crosslinking compound which possesses two or more functional groups which are capable of reacting with hydroxyl groups (normally terminal hydroxyl groups) in the polyoxyalkylene polyols. Preferred crosslinking agents for use in preparing crosslinked polyoxyalkylene polyols for use in accordance with the invention are dicarboxylic acids and diglycidyl ethers of aliphatic and aromatic polyhydroxy compounds. Examples of suitable dicarboxylic acids are glutaric acid and, preferably, adipic acid, while examples of suitable diglycidyl ethers are the diglycidyl ethers of the hydroxy compounds diphenylolmethane, pentaerythritol, trimethylolpropane, ethane-1,2-diol, propane-1,2-diol, butane-1,2-diol, butane-2,3-diol, glycerol and, especially, bisphenol A.

As indicated above, the demulsifier system used in accordance with the present invention may comprise one or more additional constituents which, together with the demulsifier impart demulsifying properties to the mixture. Examples of suitable additional constituents which may be used with crosslinked polyoxyalkylene polyol demulsifiers, are crosslinked polyoxyalkylene polyols which have been reacted with one or more alkylene oxides, for example ethylene oxide and/or propylene oxide, and esters of oxyaikylated phenol formaldehyde resins. Examples of other additional constituents include free dicarboxylic acids or anhydrides.

By a free dicarboxylic acid or anhydride is meant an acid or an anhydride which is mixed as such with at least the first or the other components of the composition or concentrate. Thus, for example, the acid or anhydride is introduced as such into the vessel or other container in which a mixture of components is to be prepared. Dicarboxylic acid/anhydride groups which are chemically incorporated in demulsifiers or other components by reaction at one or both of the carboxyl groups before the dicarboxylic acid/anhydride is blended into the composition or concentrate are not free dicarboxylic acids/anhydrides.

The dicarboxylic acid used in accordance with the invention (or the dicarboxylic acid from which an anhydride used in accordance with the present invention is derived) preferably has the general formula:

$$HO_2C—(R)—CO_2H$$

wherein R represents a divalent hydrocarbyl group. A hydrocarbyl group consists essentially of hydrogen and carbon atoms but may, if desired, contain other atoms as or in substituents or as chain members provided that the presence of such atoms or groups containing them does not result in undesired reactions occurring during the use of the dicarboxylic acid or anhydride. The hydrocarbyl group may be for example, a divalent aromatic group, but is advantageously a straight or branched chain, saturated or unsaturated, divalent aliphatic radical. Advantageously at most three chain atoms separate the two carboxyl groups, and, in preferred acids/anhydrides, the carboxyl groups are separated by two chain carbon atoms.

Especially advantageous for use in accordance with the invention are alk(en)yl succinic acids and anhydrides; the alk(en)yl radical preferably having 9 to 18 carbon atoms. A preferred alkenyl succinic anhydride is dodecenyl succinic anhydride (DDSA) especially the branched chain form thereof, tetrapropenyl succinic anhydride (TPSA).

Examples of oxyalkylated phenol formaldehyde resins which may be esterified to give a demulsifier constituent for use in accordance with the invention are resins of the formula:

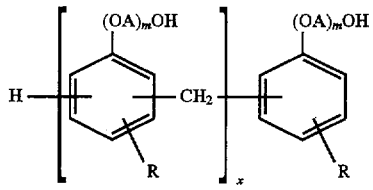

wherein A represents an alkylene group containing from 2 to about 10 carbon atoms, m has an average value of from about 4 to about 200, R represents an alkyl group having 1 to about 20 carbon atoms, and x is an integer greater than 1. The use of such resins as a demulsifier component is described in, for example, U.S. Pat. No. 4,398,921 referred to above. The group represented by R preferably has at least four carbon atoms and may be, for example, an isobutyl, tert. butyl or nonyl radical.

An additional constituent for use in accordance with the invention may be prepared by esterifying an oxyalkylated phenol formaldehyde resin with, for example, a monocarboxylic acid, advantageously a saturated or unsaturated, straight or branched chain, monocarboxylic acid, which acid preferably contains about 12 to 20 carbon atoms. Because of their ready availability, mixtures of acids containing $C_{16}$ to $C_{18}$ fatty acids are particularly preferred.

The heterocyclic compound I is a thiazole or dithiadiazole compound, preferably a dithiadiazole.

Examples of suitable substituents for R in general formula I include hydrocarbyl radicals, radicals of formula $ZR^1$ (wherein Z represents O,S, or —S—S— and $R^1$ represents a hydrocarbyl radical), hydroxyl radicals, and halogen atoms. R may be other heterocyclic rings or aromatic rings or alicyclic rings fused with the heterocyclic ring comprising S, A, B, D and E. These fused rings may themselves be substituted. By the term hydrocarbyl group is meant any group which is primarily composed of hydrogen and carbon atoms but does not exclude the presence of other heteroatoms or heteroatom containing groups. Suitable hydrocarbyl radicals are those having up to 30 carbon atoms, preferably up to 20 carbon atoms. Examples of hydrocarbyl groups include alkyl, alkenyl, aryl, aralkyl, alkaryl, alkoxy, alkylthio and arylthio groups. Especially preferred are alkyl radicals having up to 20 carbon atoms, for example up to 16 carbon atoms, especially up to 12 carbon atoms. The alkyl radicals preferably have at least 4 carbon atoms. Examples of specific alkyl radicals are n-butyl, t-butyl, i-pentyl, t-pentyl, n-hexyl, t-octyl, nonyl, n-decyl, n-dodecyl, t-dodecyl and 1,1,3,3 tetramethyl butyl radicals. These hydrocarbyl substituents may be attached to the heterocyclic ring by means of one or more heteroatoms or heteroatom containing groups or they may be substituted with one or more heteoatom or heteroatom containing groups. Examples of heteroatoms or heteroatom containing groups are amine, amide, cyano, sulfide, carboxyl, hydroxyl, oxygen, and sulfur. It is preferred that the hydrocarbyl groups are alkyl groups and are connected to the heterocyclic ring by means of mercapto groups. By mercapto group is meant a group of the formula $—(S)_nR^2$ where n is an integer from 1 to 6, preferably 1 or 2, most preferably 2, and $R^2$ is hydrogen or a hydrocarbyl group. Where $R^2$ is a hydrocarbyl group, this is preferably a $C_1$ to $C_{30}$, preferably $C_5$ to $C_{20}$, most preferably a $C_8$ to $C_{16}$ hydrocarbyl group. $R^2$ is preferably an alkyl group, which may be branched or straight chain.

Examples of heterocyclic compounds of general formula I include thiazoles, isothiazoles, 1,2,3-thiadiazoles, 1,2,4-thiadiazoles, 1,3,4-thiadiazoles, 1,2,5-thiadiazoles. The most preferred heterocyclic compounds are the thiadiazoles such as 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5bis (hydrocarbylthio)-1, 3,4-thiadiazoles and 2,5-bis (hydrocarbyidithio)-1, 3,4-thiadiazoles. In these compounds the hydrocarbyl groups are $C_1$ to $C_{30}$ preferably $C_5$ to $C_{20}$ and most preferably $C_8$ to $C_{16}$ hydrocarbyl groups. Preferably the heterocyclic compound is a 2,5-dimercapto-1,3,4-thiadiazole of the general formula:

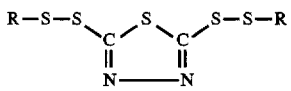

where each R is independently a hydrocarbyl group, preferably a straight chained or branched alkyl group containing from 1 to 30, more preferably from 5 to 20 and most preferably from 8 to 16 carbon atoms. Preferably R is an unsubstituted alkyl group.

Such thiazole and thiadiazole compounds are generally synthesised from hydrazine and carbon disulfide by known procedures; see for example U.S. Pat. No. 2,765,289, U.S. Pat. No. 2,749,311, U.S. Pat. No. 2,760,933, U.S. Pat. No. 2,850,453, U.S. Pat. No. 2,910,439, U.S. Pat. No. 3,663,561, U.S. Pat. No. 3,862,798 and U.S. Pat. No. 3,840,549. A general method is described in Chemistry and Technology of Lubricants, Ed. R. M. Mortier and S. T. Orszulik, Blackie Academic & Professional, 1992 at page 103. Also examples of suitable dimercaptothiadiazole compounds are commercially available materials such as Amoco 150™, Amoco 158™ and Courtaulds SC446υ available from Amoco and Courtaulds respectively.

The optimum amount of demulsifier to be used for a particular lubricating oil composition will depend in part on the type of demulsifier used, in part on the nature and proportions of the other constituents of the lubricating oil composition, and in part on the end use of the lubricating oil composition. The desired amount can be determined by routine experiment taking into account these various factors. For example, in relation to the use of dispersants in lubricating oil compositions, the demulsifier/dispersant mass ratio in a TPEO may be in the range of from about 0.001:1 to 0.1:1, more especially 0.002:1 to 0.07:1, calculated on an active ingredient basis.

The optimum amount and nature of the heterocyclic compound of general formula I to be used in a particular demulsifier composition or for a particular lubricating oil composition or concentrate will depend in part on the nature and proportions of the demulsifier used, in part on the nature and proportions of the other constituents of the lubricating oil composition, and in part on the end use of the lubricating oil composition; this optimum can be determined by routine experiment taking into account these various factors. It is essential for the purpose of the invention that for a given demulsifier and/or lubricating oil composition that the heterocyclic compound of general formula I selected and the amount used is sufficient to enhance the demulsification properties of the demulsifier in the absence of the said heterocyclic compound. In some formulations with some demulsifiers the use of low levels of heterocyclic compound in relation to the demulsifier may have no effect on the demulsifiers performance and also the use of high levels may in some circumstances have an antagonistic effect on the performance of the demulsifier. For example when the demulsifier comprises a crosslinked polyoxyalkylene polyol and the heterocyclic compound is a dimercaptothiadiazole the weight ratio of heterocyclic compound to demulsifier may be critical. For example a weight ratio of heterocyclic compound to demulsifier approaching 1 or greater results in an antagonistic interaction between the two components when used in a marine oil formulation with a consequential loss of performance. In general, it is preferred that the weight ratio of heterocyclic compound to demulsifier should be less than 1, preferably from 0.01:1 to 0.8:1, more preferably from 0.01:1 to 0.5:1, most preferably from 0.1:1 to 0.5:1, especially from 04:1 to 0.3:1.

In lubricating oil compositions such as marine oil formulations it is preferred that the demulsifier is present from 0.01 to 0.5 wt %, preferably from 0.05 to 0.3 wt %, for example about 0.1 wt %, based on weight of formulation and that the heterocyclic compound is present from 0.005 to less than 0.5 wt %, preferably from 0.01 to 0.1 wt %, more preferably from 0.01 to 0.05 wt %, for example from 0.01 to 0.03 wt % based on the weight of the formulation; calculated on an active ingredient basis.

As indicated above, lubricating oils for marine use advantageously include at least one ashless dispersant, at least one metal-containing detergent additive and at least one ZDDP.

The ashless dispersant additive for use in accordance with the invention may comprise an ashless dispersant and/or a viscosity index improver dispersant. Suitable ashless dispersants for use in accordance with the invention include, for example, the reaction products of amines, including aminoalcohols, with a hydrocarbyl-substituted mono- or dicarboxylic acid or a derivative thereof, long chain aliphatic hydrocarbons having one or more polyamine molecules attached directly thereto as shown in, for example, U.S. Pat. Nos. 3,275,554 and 3,565,804 (in which the halogen group in a halogenated hydrocarbon is displaced using an alkylene polyamine), the Mannich condensation products containing a long chain hydrocarbyl group, for example as a substituent of a phenol.

In advantageous dispersants for use in accordance with the invention, the hydrocarbyl-substituted carboxylic acid or acid derivative comprises a hydrocarbon chain, generally a polyolefin chain, to which is grafted a substance containing at least one ethylenic bond and at least one carboxylic acid or anhydride group, or a polar group which is convertible into a carboxylic group by oxidation or hydrolysis. Preferably there are two such carboxylic acid groups (or derivatives thereof), and α- or β-unsaturated $C_4$ to $C_{12}$ dicarboxylic acids or derivatives thereof are particularly advantageous. Examples of suitable acids and anhydrides are itaconic acid, maleic acid, maleic anhydride, chloromaleic acid, dimethyl fumarate, succinic anhydride, chloromaleic anhydride, acrylic acid, methacrylic acid, crotonic acid, and cinnamic acid. Preferably, the dispersant product contains from 0.5 to 2, preferably 0.8 to 1.7, more preferably 1.0 to 1.5, for example, 1.05 to 1.2 acid groups, for example succinic groups, per mole of polyolefin starting material employed.

Preferred olefin polymers for reaction with the unsaturated carboxylic acids or derivatives thereof are those polymers derived from a major molar amount of $C_2$ to $C_{10}$, e.g., $C_2$ to $C_5$, monoolefin. Such olefins include, for example, ethylene, propylene, butylene, isobutylene, pentene, octene-1, and styrene. An especially suitable starting material for a dispersant additive is polyisobutylene. The olefin polymers will usually have number average molecular weights above about 700, preferably above about 900, including number average molecular weights within the range of from 1,500 to 5,000 with approximately one double bond per polymer chain. The number average molecular weight for such polymers can be determined by any suitable technique. A convenient method for such determination is by gel permeation chromatography (GPC) which additionally provides molecular weight distribution information (see W. W. Yua, J. J. Kirkland and D. D. Bly, "Modern Size Exclusion Liquid Chromatography", John Wiley and Sons, New York, 1979).

Useful amine compounds for reaction with the hydrocarbyl substituted carboxylic acid or derivative thereof include mono- and polyamines having from 2 to 60, for example, 3 to 20, carbon atoms and from 1 to 12, for example 2 to 8, nitrogen atoms in a molecule. These amines may be hydrocarbyl amines, which may include other groups such, for example, as hydroxy groups, alkoxy groups, amide groups, nitrile groups and imidazoline groups. Hydroxy amines with 1 to 6 hydroxy groups, preferably 1 to 3 hydroxy groups, are particularly useful. The amine may be reacted with the carboxylic acid or derivative thereof, for example, alkenyl succinic anhydride, by any suitable method.

A particularly suitable dispersant for use in lubricating oil compositions is one derived from polyisobutylene substituted with succinic anhydride groups and reacted with a polyethylene amine, for example, tetraethylene pentamine, pentaethylene hexamine, polyoxyethylene or polyoxypropylene amine, for example, polyoxypropylene diamine, trismethylolaminomethane or pentaerythritol, and combinations thereof.

Certain nitrogen-containing Mannich base type dispersants such, for example, as those described in U.S. Pat. Nos. 3,649,229 and 3,798,165 (the disclosures of which are hereby incorporated by reference in their entirety) may also be used. Such Mannich base dispersants can, for example, be formed by reacting a high molecular weight hydrocarbyl-substituted mono- or polyhydroxy benzene (for example, having a number average molecular weight of 1,000 or greater) with an amine (for example, a polyalkyl polyamine, a polyalkenyl polyamine, an aromatic amine, or a carboxylic acid-substituted polyamine or the succinimide formed from any one of these with an olefinic succinic acid or anhydride) and a carbonyl compound (e.g., formaldehyde or para formaldehyde).

The nitrogen-containing dispersant can if desired be further treated by boration as generally taught in U.S. Pat. Nos. 3,087,936 and 3,254,025 (the disclosures of which are hereby incorporated by reference in their entirety).

Viscosity index improvers (or viscosity modifiers) impart high and low temperature operability to a lubricating oil and permit it to remain shear stable at elevated temperatures and also exhibit acceptable viscosity or fluidity at low temperatures. Viscosity index improver dispersants function as dispersants as well as viscosity index improvers. Examples of such viscosity index improver dispersants are compounds essentially similar to the dispersants described in detail above (that is, the reaction products of amines with a hydrocarbyl-substituted mono- or dicarboxylic acid or a derivative thereof) in which the hydrocarbyl substituent comprises a chain of sufficient length to impart viscosity index-improving properties to the compounds. Such compounds can be prepared in a manner generally similar to that described above in connection with the corresponding dispersants.

The optimum amount of dispersant will depend on the use for which the oil is intended, which will influence the precise nature and proportions of the other constituents in the oil. In a TPEO, the proportion of dispersant will typically be in the range of from 0.1 to 10 mass %, especially 0.2 to 5 mass %, calculated on an active ingredient basis. The person skilled in the art will readily be able to determine, by routine experiment, the proportion of dispersant most appropriate to a particular use.

Overbased metal-containing detergent additives for use in accordance with the invention include, for example, overbased; phenates, sulfurized phenates, sulfonates, salicylates and naphthenates of the alkali metals and alkaline earth metals. Overbased calcium sulfonates of $C_{16}$–$C_{50}$ substituted benzene- or toluene sulfonic acids, and overbased calcium sulfurized phenates, having a TBN of from 200 to 500, typically 250 to 400, are preferred.

The alkaryl sulfonates usually contain from 9 to 70 or more carbon atoms, preferably from 16 to 50 carbon atoms, per alkyl-substituted aromatic moiety.

In overbased alkaryl sulfonates the metal compound is used in excess of that required for complete neutralisation of the alkaryl sulfonic acids. Generally, the amount ranges from 100 to 220 percent, although it is preferred to use at least 125 percent, of the stoichiometric amount of metal required for complete neutralisation the excess metal present forms a dispersed carbonate complex by reacting the excess metal with carbon dioxide to provide the desired overbasing.

With overbased phenate and sulfurised phenates the average number of carbon atoms present in all of the substituent groups in the phenols used in their preparation is at least about 9 in order to ensure adequate solubility in oil. The individual substituent groups may each contain from 5 to 40, and preferably contain from 9 to 12, carbon atoms.

Considering sulfurised phenates regardless of the manner in which they are prepared, the sulfurized alkyl phenols which are used for their preparation generally contain from 2 to 14% by weight, preferably 4 to 12 wt % sulphur based on the weight of sulfurized alkyl phenol.

The sulfurized alkyl phenol may be converted to a salt by reaction with a metal-containing material, for example, a metal oxide, hydroxide or complex, in an amount sufficient to neutralise the phenol and, if desired, to overbase the product to a desired basicity. The neutral or normal sulfurized metal phenates are those in which the ratio of metal to phenol nucleus is substantially stoichiometric. The "overbased" or "basic" sulfurized metal phenates are sulfurized metal phenates wherein the ratio of metal to phenol is greater than that required by stoichiometry, e.g. basic sulfurized metal dodecyl phenate has a metal content up to and greater than 100% in excess of the metal present in the corresponding normal sulfurized metal phenates, the excess metal being present in oil-soluble or dispersible form (for example, by reaction with $CO_2$).

The overbased materials described above may be used as the sole metal detergent additive or in combination with the same additives in the neutral form and/or each other.

The ZDDPs used as anti-wear agents, and also to provide antioxidant activity, may be prepared, for example, in accordance with known techniques by first forming a dithiophosphoric acid, usually by reaction of an alcohol or a phenol with $P_2S_5$, and then neutralising the dithiophosphoric acid with a suitable zinc compound.

Mixtures of alcohols may be used, including mixtures of primary and secondary alcohols, secondary alcohols generally imparting improved anti-wear properties, and primary alcohols giving improved thermal stability properties. Mixtures of the two are particularly useful. In general, any basic or neutral zinc compound could be used but the oxides, hydroxides and carbonates are most generally employed. Commercial additives frequently contain an excess of zinc because of the use of an excess of the basic zinc compound in the neutralisation reaction.

The preferred zinc dihydrocarbyl dithiophosphates for use in the present invention are oil soluble salts of dialkyl esters of dithiophosphoric acids represented by the formula: $[RO(R'O)PS_2]_2Zn$ wherein R and R' may be the same or different alkyl radicals preferably containing 3 to 10, more preferably 3 to 8 carbon atoms and including n-propyl, i-propyl, n-butyl, i-butyl, sec-butyl, amyl, n-hexyl, i-hexyl, n-octyl, 2-ethylhexyl, cyclohexyl and methylcyclopentyl groups.

Other additives which may be used in formulating TPEOs are, for example, rust inhibitors and antioxidants, such as for example, alkylated diphenylamines.

A wide variety of lubricating oil base stocks may be used in accordance with the invention, for example, for preparing a lubricating oil composition or a concentrate in accordance with the invention. Thus, for example, suitable base stocks include natural base oils and synthetic base oils such, for example, as alkyl esters of dicarboxylic acids, polyglycols and alcohols; polyalpha-olefins, polybutenes, alkyl benzenes, organic esters of phosphoric acids and polysilicone oils.

Natural base oils include mineral lubricating oils which may vary widely as to their crude source, for example, as to whether they are paraffinic, naphthenic, mixed, or paraffinic-naphthenic, as well as to the details of their production, for example, distillation range, straight run or cracked, hydrorefined, solvent extracted and the like.

More specifically, natural lubricating oil base stocks which can be used in accordance with the invention may be straight mineral lubricating oil or distillates derived from paraffinic, naphthenic, asphaltic, or mixed base crude oils. Alternatively, if desired, various blended oils may be employed as well as residual oils, particularly those from which asphaltic constituents have been removed. The oils may be refined by any suitable method, for example, using acid, alkali, and/or clay or other agents such, for example, as aluminum chloride, or they may be extracted oils produced, for example, by solvent extraction with solvents, for example, phenol, sulphur dioxide, furfural, dichlorodiethyl ether, nitrobenzene, or crotonaldehyde.

Lubricating oil base stocks suitable for use in preparing TPEOs conveniently have a viscosity of typically about 3 to about 15 cSt (about $3\times10^{-6}$ to about $15\times10^{-6}$ $m^2/s$) at 100° C., although base stocks with other viscosities may also be used. Thus, for example, bright stocks, which typically have a viscosity of about 30 cSt (about $30\times10^{-6}$ $m^2/s$) at 100° C. may be used in some applications.

The additives used in accordance with the invention are oil-soluble, dissolvable in oil with the aid of a suitable solvent, or are stably dispersible materials. Oil-soluble, dissolvable, or stably dispersible as that terminology is used herein does not necessarily indicate that the materials are soluble, dissolvable, miscible, or capable of being suspended in oil in all proportions. It does mean, however, that the additives are, for instance, soluble or stably dispersible in oil to an extent sufficient to exert their intended effect in the environment in which the oil is employed. Moreover, the additional incorporation of other additives may also permit incorporation of higher levels of a particular additive, if desired.

Additives used in accordance with the present invention can be incorporated into lubricating oil compositions in any convenient way. Thus, they can be added directly to the oil by dispersing, or by dissolving them in the oil at the desired level of concentration. Such blending may be effected at room temperature or an elevated temperature.

Additives used in accordance with the present invention may be employed in a lubricating oil composition which comprises lubricating oil, typically in a major amount, and the additives, typically in a minor amount. Additional additives, for example, the additional additives indicated above, may be incorporated in the composition to enable it to meet particular requirements.

As indicated above, the present invention has special relevance to marine oils such as TPEOs and system oils. Typical proportions for some additional additives for a TPEO in accordance with the invention are as follows:

| Additive | Mass % Active Ingredient |
|---|---|
| Detergent(s) | 0.5 to 20 |
| ZDDP(s) | 0.1 to 1.5 |
| Antioxidant(s) | 0.0 to 4 |
| Rust Inhibitor(s) | 0 to 0.2 |

As also indicated above, it may be desirable, although not essential, to prepare additive concentrates comprising the additives (the concentrate sometimes being referred to herein as an additive package) whereby several additives can be added simultaneously to the base oil to form the lubricating oil composition. Dissolution of the additive concentrate into the lubricating oil may be facilitated by solvents and by mixing accompanied with mild heating, but this is not essential. The concentrate or additive package will typically be formulated to contain the additive(s) in proper amounts to provide the desired concentration in the final formulation when the additive package is combined with a predetermined amount of base lubricant. Thus, one or more additives can be added to small amounts of base oil or other compatible solvents along with other desirable additives to form additive packages containing active ingredients in an amount of, for example, from about 20 to about 70 mass %, and preferably from about 40 to about 65 mass %, additives in the appropriate proportions with the remainder being base oil. The final formulations may employ typically about 4 to 20 mass % of the additive package with the remainder being base oil.

The following Examples illustrate the invention.

EXAMPLE 1

Test oils suitable for use as TPEOs were formulated as follows. An additive package comprising an ashless dispersant, a calcium phenate, a calcium sulfonate, a ZDDP and antioxidants were mixed in a vessel containing base oil. To this mixture was added the demulsifier or the demulsifier as a two thirds diluted solution in nonyl phenol. The demulsifier was a blend (92 mass % active ingredient in diluent oil) of a propoxylated dipropylene glycol crosslinked with the diglycidylether of bisphenol A, and two different constituents prepared by reacting with propylene oxide, or ethylene oxide and propylene oxide, a propoxylated dipropylene glycol crosslinked with the diglycidyl ether of bisphenol A. A commercially available 2,5-dimercapto-1,3,4-thiadiazole was used as the heterocyclic compound. Details of the formulations are provided in Table 1.

Each formulation was tested for its water shedding properties one week after formulation. The test was carried out using the ERCA Water Shedding Centrifuge Test as detailed in "Marine Lubricants Performance: Simulation and Field Experience" P. Casale, D. Davidson and G. Lane, ISME KOBE '90, October 1990. This test simulates a batch contamination by water in the field and briefly involves contaminating a 6 kg sample of the oil with 300 $cm^3$ of water which is then cycled in a centrifuge and samples of centrifuged oil are drawn at intervals representing one or more cycles; the amount of water removed at each cycle is measured. The results are listed in Table 1.

The results clearly show that the 2,5-dimercapto-1,3,4-thiadiazole has an enhancing effect on the activity of the demulsifier at surprisingly low levels (see results for Formulations 2, 5 and 6). The results also show that at wt ratios of demulsifier to 2,5-dimercapto-1,3,4-thiadiazole of 1:1 (see result for Formulation 3) there is an antagonistic effect; the performance of Formulation 3 is inferior to that achieved without 2,5-dimercapto-1,3,4-thiadiazole (see Formulations 1 and 4).

TABLE 1

| | Formulation No (Wt %) | | | | | |
|---|---|---|---|---|---|---|
| Component | 1 | 2 | 3 | 4 | 5 | 6 |
| Dimercaptothiadiazole | 0 | 0.03 | 0.10 | 0 | 0.01 | 0.03 |
| Demulsifier | 0.10 | 0.10 | 0.10 | — | — | — |
| Demulsifier solution | — | — | — | 0.33 | 0.33 | 0.33 |
| % Water Removed at 1 cycle | 67/65* | 81 | 23/42* | 52 | 78 | 77 |

*These are the results from two separate tests.

I claim:

1. A demulsifier composition comprising;

a) optionally an oleaginous medium, and b) a demulsifier system formed from mixing:

(i) at least one demulsifier derived from epoxy group-containing materials, optionally with one or more additional constituents selected from oxyalkylene groups and one or more free acids/anhydrides, or a mixture thereof, and (ii) at least one heterocyclic compound of general formula I.

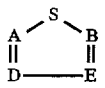

I wherein each of A, B, D and E is either nitrogen or a —CR group where R is hydrogen, a mercapto group, or a substituted or an unsubstituted hydrocarbyl group, provided at least one and no more than two of A, B, D and E is/are nitrogen, wherein the weight ratio of heterocyclic compound (ii) to demulsifier (i) is less than 1:1.

2. The demulsifier composition according to claim 1 wherein the weight ratio of the heterocyclic compound to the demulsifier is from 0.01:1 to 0.8:1, 3. A demulsifier system according to claim 1 wherein the weight ratio of the heterocyclic compound to the demulsifier is from 0.1:1 to 0.5:1.

4. The demulsifier system according to claim 1, 2 or 3 wherein the heterocyclic compound is a thiadiazole compound.

5. The demulsifier composition according to claim 1, 2 or 3 wherein each R is a mercapto group.

6. The demulsifier composition according to claim 1, 2 or 3 wherein the demulsifier comprises a crosslinked polyoxyalkylenepolyol.

7. The demulsifier composition according to claim 1 or 2 wherein the said additional constituent comprises oxyalkylene groups and/or one or more free diacids/dianhydrides.

8. A lubricating oil composition comprising an oil of lubricating viscosity as a major component, and an effective amount of a demulsifier system as defined in claim 1.

9. A lubricating oil composition according to claim 8 which contains from 0.01 to 0.5 wt % demulsifier and from 0.005 to less than 0.5 wt % heterocyclic compound based on the total weight of the composition.

10. A concentrate useful as an additive for a lubricating oil composition which concentrate comprises oil and/or a solvent miscible with oil as a minor component, and a demulsifier system as defined in claim 1.

11. A method for enhancing the demulsification activity of a demulsifier in a water in oil emulsion by adding to the demulsifier a heterocyclic compound of the formula

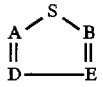

wherein each of A, B, D and E is either nitrogen or a —CR group wherein R is hydrogen, a mercapto group or a substituted or an unsubstituted hydrocarbyl group, provided at least one and no more than two of A, B, D and E is/are nitrogen, wherein the heterocyclic compound is added to the demulsifier in a weight ratio of less than 1:1.

12. The method of claim 11 wherein the heterocyclic compound is thiadiazole compound.

13. The method of claim 11 wherein the weight ratio of the heterocyclic compound to the demulsifier is from 0.01:1 to 0.8:1.

14. The method of claim 11, 12 or 13 wherein each R is a mercapto group.

15. The method of claim 11, 12 or 13 wherein the demulsifier comprises at least one demulsifier derived from epoxy group containing materials.

16. A method for improving the water shedding properties of a lubricating oil composition by adding to the lubricating oil composition an effective amount of a demulsifier system comprising (i) at least one demulsifier, optionally with one or more additional constituents, and (ii) at least one heterocyclic compound of general formula

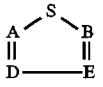

wherein each of A, B, D and E is either nitrogen or a —CR group wherein R is hydrogen, a mercapto group or a substituted or an unsubstituted hydrocarbyl group, provided at least one and no more than two of A, B, D and E is/are nitrogen, wherein the heterocyclic compound is added to the demulsifier in a weight ratio of less than 1:1.

17. The method of claim 16 wherein the heterocyclic compound is a thiadiazole compound.

18. The method of claim 16 wherein the weight ratio of the heterocyclic compound to the demulsifier is from 0.01:1 to 0.8:1.

19. The method of claim 16, 17 or 18 wherein each R is a mercapto group.

20. The method of claim 16, 17 or 18 wherein the demulsifier comprises at least one demulsifier derived from epoxy group containing materials.

21. A method for improving the water shedding properties of a lubricating oil composition by adding to the lubricating oil composition an effective amount of a demulsifier system comprising the reaction product of (i) at least one demulsifier, and (ii) at least one heterocyclic compound of general formula

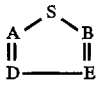

wherein each of A, B, D and E is either nitrogen or a CR group wherein R is hydrogen, a mercapto group or a substituted or an unsubstituted hydrocarbyl group, provided at least one and no more than two of A, B, D and E is/are nitiogen, wherein the weight raation of the heterocyclic compound to the demulsifier is less than 1:1.

22. The method of claim 21 wherein the heterocyclic compound is a thiadiazole compound.

23. The method of claim 21 wherein the weight ratio of the heterocyclic compound to the demulsifier is from 0.01:1 to 0.8:1.

24. The method of claim 21, 22 or 23 wherein each R is a mercapto group.

25. The method of claim 21, 22 or 23 wherein the demulsifier comprises at least one demulsifier derived from epoxy group containing materials.

* * * * *